United States Patent [19]

Dinter et al.

[11] Patent Number: 4,980,965

[45] Date of Patent: Jan. 1, 1991

[54] METHOD FOR WINDING A SOFT-MAGNETIC RIBBON TO FORM A SELF-CONTAINED MAGNETIC CORE

[75] Inventors: Reiner Dinter, Bruchkoebel; Ewald Hientzsch, Rodenbach; Karl-Friedrich Daus, Bruchkoebel, all of Fed. Rep. of Germany

[73] Assignee: Vacuumschmelze GmbH, Fed. Rep. of Germany

[21] Appl. No.: 470,808

[22] Filed: Jan. 26, 1990

[30] Foreign Application Priority Data

Feb. 14, 1989 [DE] Fed. Rep. of Germany ..... 3904313

[51] Int. Cl.[5] ..... H01F 41/02

[52] U.S. Cl. ..... 29/609; 228/191; 228/264

[58] Field of Search ..... 29/609, 605; 228/191, 228/264

[56] References Cited

U.S. PATENT DOCUMENTS 2,160,588 5/1939 Granfield ..... 29/609 X 2,282,854 5/1942 Driftmeyer ..... 29/605 X 4,134,606 1/1979 Menti, Jr. ..... 228/191 X

*Primary Examiner*—Carl E. Hall

[57] ABSTRACT

A method for winding a soft-magnetic ribbon to form a self-contained magnetic core using a winding arbor includes the step of, after the ribbon has been wound on the arbor, holding the free end of the ribbon to the preceding turn by spot welds, disposed in general alignment along a center of the ribbon. The free end of the ribbon may be tapered, so that projecting corners are avoided. By making the spot welds substantially in the center of the ribbon, the formation of eddy currents, which may occur if the spot weld accidentally connected two adjacent turns of the ribbon, are avoided. A similar method may be used to releasably attach the beginning of the ribbon to the arbor, with the spot welds then being broken when the core is removed from the arbor. The method is particularly suited for winding a ribbon consisting of amorphous soft-magnetic material.

4 Claims, 1 Drawing Sheet

METHOD FOR WINDING A SOFT-MAGNETIC RIBBON TO FORM A SELF-CONTAINED MAGNETIC CORE

BACKGROUND OF THE INVENTION

1. Field of the Invention

The present invention is directed to a method for winding a soft-magnetic ribbon to form a self-contained magnetic core, and in particular to such a method wherein the ribbon is wrapped around a rotating winding arbor.

2. Description of the Prior Art

A winding apparatus for ribbons used to form a magnetic core is described, for example, in German Patent 31 34 326. A method is disclosed therein which defines in detail the manner of controlling the tensile stress on the ribbon specifically for winding a rectangular magnetic core.

SUMMARY OF THE INVENTION

It is an object of the present invention to provide a method for winding a soft-magnetic band to form a magnetic core wherein the beginning of the ribbon can be temporarily secured to the winding arbor in a simple manner, and wherein the free end of the ribbon, after the core has been wound, can be reliably and economically attached to the remainder of the core, to prevent unwinding.

The method is particularly suited for winding a soft-magnetic (low retentivity) ribbon, band or tape consisting of amorphous material. As used herein, the term "self-contained magnetic core" means a core, such as a toroidal core, wherein the finished product does not have a centrally disposed spool around which the ribbon is wound nor an exterior frame or holder which keeps the core wound.

A problem exists in the fashioning of toroidal cores consisting of amorphous metal in that the material, although soft-magnetic, is mechanically hard. This makes fastening of the free ribbon ends at the beginning and end of the winding process problematic. The fastening at the beginning of the winding process must be temporary only, because the finished core must be removed from the arbor at the conclusion of the winding process. It is also necessary to reliably fasten the free end of the ribbon to the remainder of the core at the conclusion of the winding processing. In accordance with the principles of the present invention, the use of spot welding in the manner defined below solves these problems.

In accordance with the principles of the present invention, spot welding of the beginning and/or the end of the ribbon is undertaken with a plurality of spot welds, disposed substantially in alignment in the windings direction at a center of the ribbon. By using a plurality of spot welds disposed in the middle of the ribbon following each other, the possibility of making an unwanted electrical connected between adjacent winding turns is avoided, such inadvertent connections resulting in unwanted eddy currents when the magnetic core is in use.

In combination with the spot welding in the aforementioned manner, the free ends of the ribbon are tapered, such as to a point, which avoids, in the subsequent manipulation of the magnetic core, problems resulting from projecting corners or edges.

DESCRIPTION OF THE PREFERRED EMBODIMENTS

Figure 1:
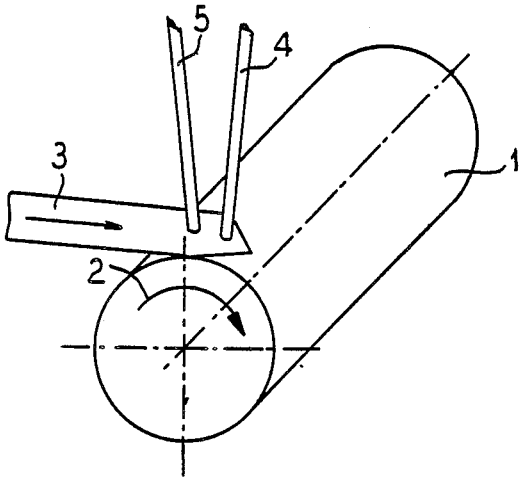
FIG. 1 shows the start of the formation of a magnetic core using the method in accordance with the principles of the present invention.

A winding arbor 1 is shown in FIG. 1, which rotates in the direction of the arrow 2. A free end of, for example, an amorphous soft-magnetic ribbon 3 is provided from a feed location (not shown) so that the free end is just over the surface of the winding arbor 1. Two spot welding electrodes 4 and 5 are moved into contact with the ribbon 3 at this time, and secure the free end of the ribbon to the rotating winding arbor 1 with a relatively low welding current. The welding current and welding time are selected so that the end of the ribbon can be attached to the winding arbor 1 in a sufficiently firm manner, but also so that the connection can be broken at a later time, such as by shearing, when the magnetic core is completely wound.

It has been shown that a suitable adjustment of the welding intensity, particularly for amorphous, i.e., mechanically hard, ribbons, permits a reliable, temporary weld to be obtained without damaging the winding arbor due to the spot welds, even when a number of magnetic cores are wound in succession.

Figure 2:
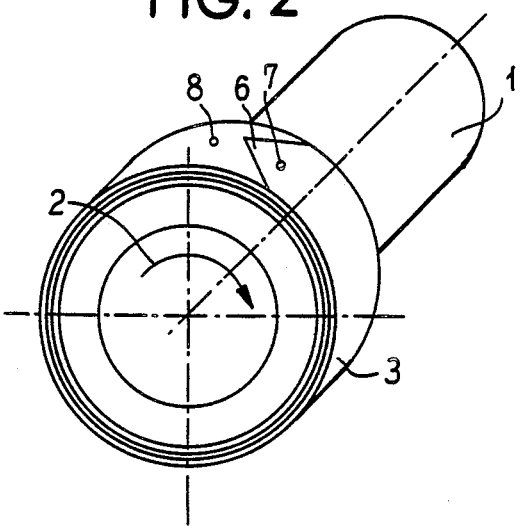
FIG. 2 shows the completion of the winding of a magnetic core in the method according to the principles of the present invention.

FIG. 2 schematically shows the arrangement of the ribbon on the winding arbor 1 at the conclusion of the winding process. The winding arbor 1 continues to rotate, and the free end 6 of the ribbon 3 has been rotated beneath the spot weld electrodes 4 and 5. The spot weld electrodes 4 and 5 generate two spot welds 7 and 8, which are disposed following each other in the winding direction substantially in a center of the ribbon 3. The free end 6 of the ribbon 3 may be slightly bent toward the center of the core. The free end 6 is cut so that its width diminishes (tapers) toward the center of the ribbon 3 in the winding direction. The free end 6 may proceed roughly to a point.

In the embodiment of FIG. 2, the spot welds 7 and 8 are such that only one spot weld happens to join the free end 6 of the ribbon 3 to the remainder of the magnetic core, i.e., to the preceding turn of the ribbon 3. It is also possible to rotate the core so that both spot welds 7 and 8 are used to join the free end 6 to the remainder of the magnetic core if, for example, the free end 6 were shifted slightly toward the left in FIG. 2. It is apparent, however, that a certain tolerance in the location of the spot welds 7 and 8 is admissible, so that the economic fabrication of many magnetic cores in succession is enabled.

By arranging the spot welds 7 and 8 (and the spot welds to the arbor 1 at the beginning of the winding process) following each other in the direction of the magnetic flux which will permeate the magnetic core when in use, the avoidance of an eddy current path is achieved. Such eddy current paths between adjacent layers of the winding will result if those adjacent layers are inadvertently electrically connected. By maintaining the spot welds substantially in the center of the ribbon, this is avoided. It is also possible to use more than two spot welds without significantly deteriorating the magnetic properties of the magnetic core.

After the magnetic core has been completely wound and the spot welds 7 and 8 have been made to retain the free end 6 of the ribbon 3, the finished core can be stripped from the winding arbor 1, for example by a sleeve which surrounds the surface of the winding arbor 1 and which slides along its longitudinal axis, thereby shearing the welds which temporarily attached the beginning end of the ribbon 3 to the winding arbor 1. Such shearing thereby prepares the windings arbor 1 to receive the next ribbon to be wound.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for winding a soft-magnetic ribbon to form a self-contained magnetic core comprising the steps of:

wrapping a ribbon around a rotating winding arbor in a winding direction thereby forming a toroid having a plurality of ribbon turns;

cutting an end of said ribbon at a last turn so that said ends tapers along its width; and attaching the tapered end of the ribbon to a remainder of the windings with at least two spot welds disposed substantially in alignment in the winding direction in a center of said ribbon.

2. A method as claimed in claim 1, comprising the addition step of using a ribbon consisting of low-retentivity amorphous material as said ribbon.

3. A method for winding a soft-magnetic ribbon to form a self-contained magnetic core comprising the steps of:

attaching a first free end of a ribbon to a rotating winding arbor by at least one temporary spot weld;

rotating said winding arbor a plurality of times in a winding direction to form a toroid of said ribbon having a plurality of turns;

cutting a second end of said ribbon so that said ribbon tapers along its width;

attaching said second end of said ribbon to a remainder of said core with at least two spot welds disposed substantially in alignment in the winding direction in a center of said ribbon; and breaking said spot weld at said first end to remove said toroidal core from said winding arbor.

4. A method as claimed in claim 3, comprising the additional step of using a ribbon consisting of low-retentivity amorphous material as said ribbon.

* * * * *